United States Patent [19]

Tucker

[11] Patent Number: 5,052,838

[45] Date of Patent: Oct. 1, 1991

[54] MECHANICAL PENCIL

[75] Inventor: William E. Tucker, Attleboro, Mass.

[73] Assignee: The Gillette Company, Boston, Mass.

[21] Appl. No.: 527,105

[22] Filed: May 22, 1990

[51] Int. Cl.[5] ..... B43K 21/22

[52] U.S. Cl. ..... 401/65; 401/67; 401/92

[58] Field of Search ..... 401/67, 56, 65, 32, 401/92

[56] References Cited

U.S. PATENT DOCUMENTS

| | | | |
|---|---|---|---|
| 381,612 | 4/1888 | Bussler | 401/67 |
| 2,203,160 | 6/1940 | Kovacs | 401/67 |
| 2,520,796 | 8/1950 | Bouhier | 401/65 X |
| 2,657,671 | 11/1953 | Wade | 401/92 |
| 2,700,959 | 2/1955 | Einsele | 401/67 |
| 4,452,544 | 6/1984 | Sumita | 401/67 |

FOREIGN PATENT DOCUMENTS

| | | | |
|---|---|---|---|
| 170153 | 1/1952 | Austria | 401/67 |

*Primary Examiner*—Richard J. Johnson

*Attorney, Agent, or Firm*—Aubrey C. Brine; Owen J. Meegan

[57] ABSTRACT

A mechanical lead pencil having the capability of feeding different diameter leads. A first collet is disposed in the pencil barrel for feeding the lead and a second collet is located at the barrel open end for retaining the lead during use of the pencil. An elastomeric disc is provided between the two collets, having a variable diameter opening at the center thereof for frictionally engaging the lead and preventing its release when the two collets are in the open position.

9 Claims, 2 Drawing Sheets

MECHANICAL PENCIL

BACKGROUND OF THE INVENTION

The present invention relates to continuous feed pencil mechanisms, and more particularly to a continuous feed pencil mechanism which is capable of employing leads of more than one diameter size.

Various mechanical lead pencil designs have been marketed in the past which have met with consumer acceptance and a number of feed mechanisms have been proposed for these pencils.

A recent development in the mechanical lead pencil market has been the introduction of a continuous feed pencil which is adapted to take a cartridge containing a plurality of leads, or wherein a number of leads are introduced into the pencil mechanism to be fed singly through the feed mechanism.

The mechanical lead pencils in the marketplace, however, are generally restricted to a single lead diameter due to the construction of the feed mechanism. While there are two common lead diameters, 0.5 millimeters and 0.7 millimeters employed for use in a pencil of this type, the 0.7 millimeter lead generally may not be fed through the front opening in the smaller diameter pencil barrel due to the limited size of the opening to support the 0.5 millimeter lead for which the pencil is constructed. In like manner, the 0.5 millimeter lead, when fed through the front opening in the barrel of a pencil constructed to employ the 0.7 millimeter lead, will break due to the enlarged opening providing inadequate support for the lead protruding from the opening of the pencil.

Quite often, it is necessary that the consumer employ a pencil with 0.5 millimeter lead for use in such activities as engineering or accounting while the consumer may prefer a 0.7 millimeter lead for general writing purposes. It is therefore necessary for a user to have at least two pencils in order to satisfy his needs to obtain adequate and acceptable line quality.

As is evident from the above, it is necessary therefore that the vendor of lead refills for those mechanical pencils on the market today stock various sizes of lead to accommodate the various feed mechanisms found in those pencils which is customary might employ. Additionally, it is often confusing to the owner of a mechanical pencil when buying refill leads to determine which lead size a particular pencil requires and he often finds that in attempting to refill the pencil, he has purchased the wrong size lead.

A need has therefore arisen for a continuous feed lead pencil having a feed mechanism which will accept a plurality of lead diameters.

It is therefore an object of the present invention to provide a mechanical lead pencil of the feed through type wherein the feed mechanism is adaptable to accept a plurality of lead diameters.

A further object of the present invention is to provide a mechanical lead pencil having a feed mechanism accepting a plurality of lead diameters which is manufactured without a radical departure from those continuous feed pencil mechanisms being mass produced.

Yet another object of the invention is to provide a mechanical lead pencil having a continuous feed mechanism which is simple in construction and economical to produce by known production methods.

SUMMARY OF THE INVENTION

The aforementioned objects and other objectives which will become apparent as the description proceeds are accomplished by providing a mechanical lead pencil of the feed through type employing a replaceable lead which comprising a cylindrical elongated barrel having an opening formed at the front end thereof through which the lead is directed. A first means for releasably engaging the lead and moving the lead toward the barrel front end is located at a point spaced from the barrel front end and a second means for releasably engaging the lead is disposed at the opening at the front end of the barrel.

Means for frictionally engaging the lead is disposed between the first and second lead engaging means to maintain the lead positioned in the barrel when the lead is released by the first and second lead engaging means.

The means for frictionally engaging the lead may comprise a disc of elastomeric material having a circular opening formed in the center thereof for receiving the lead in frictional engagement and further may comprise a plurality of slits formed therein disposed radially outwardly from the circular opening, extending through the thickness of the disc to allow greater flexibility of the circular opening formed in the center of the disc.

In a more detailed sense, the first means for releasably engaging the lead is preferably a collet having a plurality of collet member biased outwardly from the lead retained in the pencil barrel and a collet collar for retaining the collet members in engagement with the lead when the collet is in a rearward location in the barrel. The second means for releasably engaging the lead may also comprise a collet having a plurality of collet fingers, the collet fingers extending partially beyond the barrel front end and biased outwardly from the axis of the barrel. The barrel front end opening or tip may comprises an inner wall tapered forwardly outwardly at an acute angle with the axis of the barrel and the collet fingers which are disposed at the barrel opening comprise an outer surface engaged with the tapered wall whereby during forward and rearward movement the collet is retained in sliding engagement with the inner tapered wall by the outward bias of the collet fingers.

BRIEF DESCRIPTION OF THE DRAWING

The foregoing and other features of the invention will be more particularly described in connection with the preferred embodiment and with reference to the accompanying drawing, wherein.

DESCRIPTION OF THE PREFERRED EMBODIMENT

Figure 1:
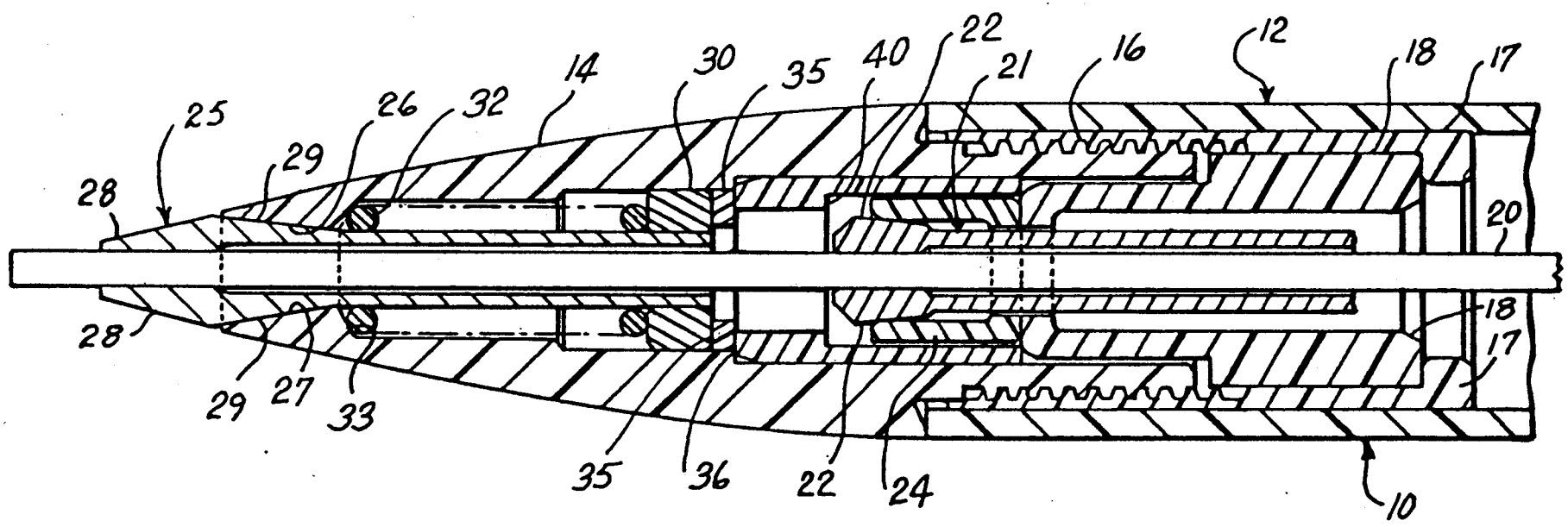
FIG. 1 is an elevational sectional view showing details of a mechanical lead pencil embodying the teachings of the present invention.
Figure 2:
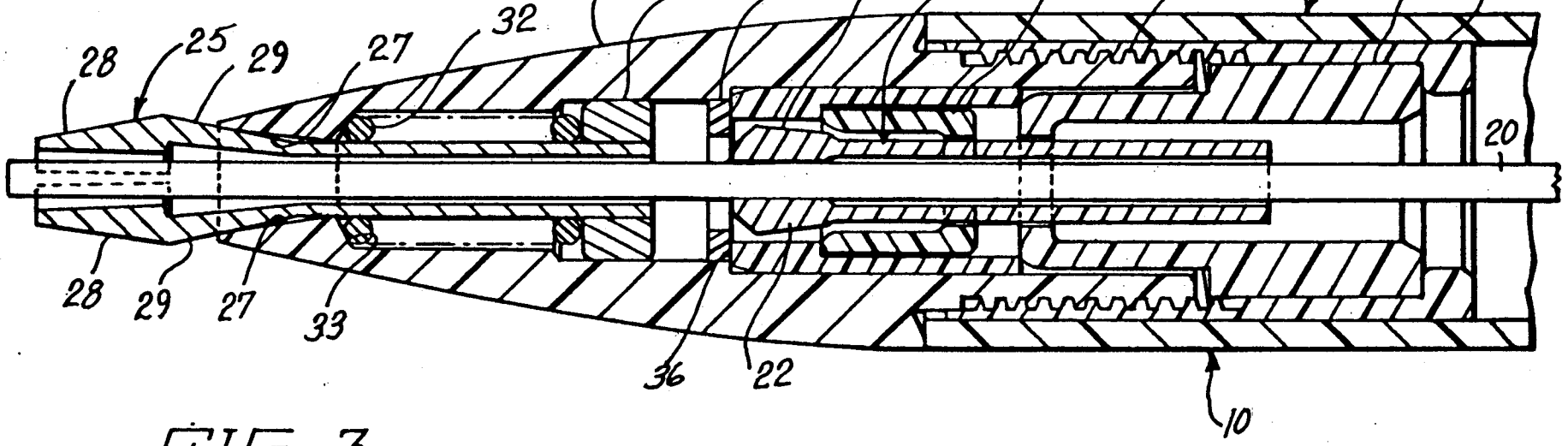
FIG. 2 is an elevational sectional view similar to FIG. 1 showing details of the pencil of FIG. 1 during operation.

Referring now to the drawing and in particular to FIGS. 1 and 2, there is shown a mechanical lead pencil 10 of the feed through type comprising a barrel 12, the barrel 12 including a barrel tip 14, having external threads 16 disposed on the external surface at the rear thereof. The barrel 12 further has a bushing 17 fixed to the inner surface thereof, and a stationary sleeve 18 which may be press fit into the bushing 17 such that the bushing 17 and sleeve 18 remain fixed from rotation or movement in the axial direction, within the barrel 12. The bushing 17 is provided with threads 19 on the inner forward surface thereof for mating with the threads 16 on the barrel tip 14 such that the barrel tip 14 may be removed in assembling the various components located at the forward end of the barrel 12.

Means for releasably engaging a lead 20 is provided in the form of a three place collet 21 comprising collet members 22, only two of which are depicted in FIGS. 1 and 2 for descriptive purposes. Collet 21 is biased rearwardly in the barrel 12 by a spring (not shown) or other means with a force sufficient to retract the collet members 22 into a cylindrical collet collar 24 which is movable within the barrel tip 14.

With the collet 21 biased rearwardly, as best shown in FIG. 1, the angular outer surfaces of the collet members 22 provide a wedging action between the collet collar 24 and the lead 20 which causes the combination of the collet collar and collet members 22 to provide a substantial gripping force onto the lead 20.

Referring still to FIG. 1, a second collet 25 is disposed at the front end of the barrel tip 14, partially extending beyond a front opening 26 through which the lead 20 extends for writing purposes. The collet 25 comprises three collet fingers 28 (only two of which are shown) which are biased outwardly by the spring action of the fingers. The opening 26 of the barrel tip 14 is provided with a forwardly outwardly canted surface 27, and the collet fingers 28 each have an outwardly facing surface 29 which is angled rearwardly inwardly to correspond to the surface 27 and mate therewith when the collet 25 is in its rearward most position, as shown in FIG. 1. A toroidaly shaped retainer ring 30 which may be of plastic, metal or other substantially rigid material is disposed within the barrel tip 14 with the rearward extensions of the spring collet fingers 18 retained therein. The retainer ring 30 is affixed to the ends of the collet fingers 28 and a spring 32 is disposed between the retainer ring 30 and the surface 33 of the barrel tip 14 and is effective to bias the collet 25 rearwardly into the position shown in FIG. 1.

Figure 3:
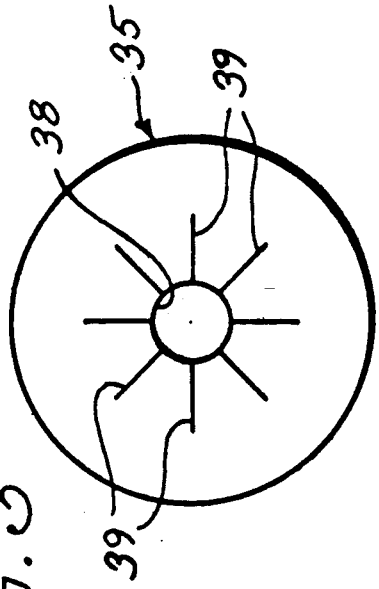
FIG. 3 is a front elevational view showing one element of the structure of FIGS. 1 and 2, taken on an enlarged scale for clarity.

Referring to FIGS. 1 and 3, a circular disc 35 of elastomeric material is provided between the bearing surfaces 36 and the rear surface of the retainer ring 30.

As best shown in FIG. 3, the disc 35 has a circular opening 38 formed therein and a plurality of slits 39 directed radially outwardly from the opening 38, and extending through the thickness of the disc. The material of the disc may be rubber or other elastomeric material and the thickness is such that the segments of the disc between the slits 39 are capable of flexing to accommodate a plurality of various diameter objects within the opening 38. While the means for frictionally engaging the lead is herein shown as the disc 35, it should be understood that the structure adjacent the circular opening 38 could comprise integrally molded fingers or other means providing sufficient flexure to accommodate leads of more than one diameter.

In operation, the mechanical pencil is employed for writing purposes with the lead 20 disposed within the barrel 12 as shown in FIG. 1 while an adequate amount of lead extends beyond the tip of the collet 25 which forms the forward most portion of the pencil 10. As will be observed in FIG. 1, the lead 20 is gripped firmly by the collet members 22, is frictionally retained in the disc 35 and is gripped by the collet fingers 28 which serve to stabilize the lead against the radial movement during the writing process. The collets 21 and 25 are capable of opening to accept a plurality of diameter leads while still maintaining their function of gripping the lead and supporting it during the writing process. In like manner, the disc 35, being formed of an elastomeric material, and being provided with the slits 39, is capable of accepting a plurality of diameter leads and providing a frictional gripping force on the lead when received in the opening 38. The lead 20 may be a single lead which is fed into the pencil or may be one of a number of leads contained in a dispensing cartridge, as is well known in the art.

Referring now to FIG. 2, when it is desired to move the lead 20 forward through the barrel 12, the collet 21 is moved forwardly towards the opening 26 in the barrel tip 14. Movement of the collet 21 in the forward direction may be accomplished in any manner well known in the mechanical pencil art, for example by applying manual pressure to the rear of the pencil, or at the eraser, to force the collet forwardly into the barrel against the aforementioned spring bias in the rearward direction. As described above, the collet members 22 and the collet collar 24 are locked about the perimeter of the lead 20 resulting in the lead 20, collet members 22 and the collet collar 24 being moved forwardly in the barrel 12 by movement of the collet 21 in the forward direction. A rearwardly facing stop surface 40 extends radially inwardly in the opening of the barrel 12 and upon contacting the stop surface, the collet collar 24 ceases its movement and the further movement of the collet members 22 cause them to be released from the collet collar 24 and to spring to the open position, releasing the lead 20, as shown in FIG. 2.

At the forward end of the barrel tip 14, with the collet 25 locked in gripping relation with lead 20, movement of the lead causes the collet fingers 28 to move forwardly against the bias of the spring 32 and in so doing, the collet fingers 28 are caused to open by virtue of the spring action in the spring fingers and the lead is released, as shown in FIG. 2.

At the point of the movement of the lead 20 wherein the lead has reached its forward most position in the above-described operation, the collet members 22 and the collet fingers 28 are both released from the lead 20. However, the lead is not free to fall from the barrel 12, as it is held in frictional engagement in the disc 35 and retained in position while the collet 21 and the collet 25 are returned to their rearward most position, as shown in FIG. 1.

As observed in the structure described above, the collet 21, the disc 35 and the collet 25 each serve distinct and separate functions in operation of the mechanical pencil 10. The collet 21 is effective to grip the lead 20 and move it forwardly to extend the lead beyond the opening 26 of the barrel tip 14 while the collet 25 serves to grip the lead 20 and rigidly support the lead adjacent its free end during the writing operation. The disc 35 is effective to retain the lead 20 within the barrel at the point of operation wherein the lead is released by both the collet 21 and collet 25. However, each of the elements, the collet 21, the collet 25 and the disc 35 are capable of performing the particular function set forth when a plurality of lead diameters are employed in the pencil. Thus, the pencil 10 provides a versatile writing instrument in that the user is not restricted to either the 0.5 millimeter or the 0.7 millimeter leads, as is the case with prior art writing instruments.

Although it is obvious that modifications and changes may be made within the spirit and scope of the present invention, it is my intention, however, only to be limited by the appended claims.

As my invention, I claim:

1. A mechanical lead pencil of the feed through type adapted for accepting replaceable leads of more than one diameter, comprising:

a cylindrical elongated barrel having an opening formed at the front end thereof through which a lead is directed;

first means for releasably engaging the lead and moving said lead toward said barrel end disposed at a point spaced releasably from said barrel end;

second means for releasably engaging the lead disposed at said opening in the front end of said barrel;

means for frictionally engaging the lead disposed between said first and second lead engaging means comprising a disc of elastomeric material having a circular opening formed in the center thereof for receiving the lead in frictional engagement, said disc having a plurality of slits formed therein directed radially outwardly from said circular opening and extending through the thickness of said disc.

2. A mechanical lead pencil as set forth in claim 1 wherein said first means for engaging the lead comprises a collet comprising a plurality of collect member biased outwardly from the axis of said barrel and a collect collar for retaining said collet members in engagement with a lead when said collet is in a rearward location in said barrel.

3. A mechanical lead pencil as set forth in claim 1 wherein said second means for releasably engaging the lead comprises a collet having a plurality of collet fingers, said collet fingers extending partially beyond said barrel front end and biased outwardly form the axis of said barrel.

4. A mechanical lead pencil as set forth in claim 3 which further includes spring means disposed in said barrel for urging said collet rearwardly in said barrel.

5. A mechanical lead pencil as set forth in claim 3 wherein said barrel front end opening comprises an inner wall tapered forwardly outwardly at an acute angle with the axis of said barrel, and said collet fingers comprising an outer surface engaged with said tapered wall whereby during forward and rearward movement of said collet, said collet is retained in sliding engagement with said inner tapered wall by the outward bias of said collet fingers.

6. A mechanical lead pencil as set forth in claim 3 wherein said first means for engaging the lead comprises a collet comprising a plurality of collet members biased outwardly from the axis of said barrel and a collet collar for retaining said collet members in engagement with a lead when said collet is in a rearward location in said barrel.

7. A mechanical lead pencil as set forth in claim 6 which further includes spring means disposed in said barrel for urging said second collet rearwardly in said barrel.

8. A mechanical lead pencil as set forth in claim 7 wherein said barrel front end opening comprises an inner wall tapered forwardly, outwardly at an acute angle with the axis of said barrel, and said collet fingers of said second collet comprise an outer surface engaged with said tapered wall whereby during forward and rearward movement of said collet said second collet is retained in sliding engagement with said inner tapered wall by the outward bias of said collet fingers.

9. A method of feeding lead through the barrel of a mechanical lead pencil which includes the steps of:

providing a first means for releasably engaging the lead at a point spaced from the barrel front end, a second means for releasably engaging the lead disposed at the barrel front end and a disc of elastomeric material having a circular opening formed at the center thereof and a plurality of slits directed radially outwardly from said opening formed through the thickness of said disc; and moving the lead forward through the barrel front end by movement of the first and second means to a forwardmost position and releasing the first and second means while retaining the lead in frictional engagement with the circular opening to return the first and second means to a rearwardmost position while the lead remains in the forward position.

* * * * *